US011833096B2

(12) United States Patent
Brenner et al.

(10) Patent No.: US 11,833,096 B2
(45) Date of Patent: Dec. 5, 2023

(54) AMBULATORY RESPIRATORY ASSIST DEVICE

(71) Applicant: The Trustees of the University of Pennsylvania, Philadelphia, PA (US)

(72) Inventors: Jacob Brenner, Princeton Junction, NJ (US); Christopher Polster, Portland, OR (US); Michael Sims, Mount Laurel, NJ (US)

(73) Assignee: The Trustees of the University of Pennsylvania, Philadelphia, PA (US)

( * ) Notice: Subject to any disclaimer, the term of this patent is extended or adjusted under 35 U.S.C. 154(b) by 878 days.

(21) Appl. No.: 16/086,892

(22) PCT Filed: Mar. 21, 2017

(86) PCT No.: PCT/US2017/023326
§ 371 (c)(1),
(2) Date: Sep. 20, 2018

(87) PCT Pub. No.: WO2017/165359
PCT Pub. Date: Sep. 28, 2017

(65) Prior Publication Data

US 2019/0105225 A1 Apr. 11, 2019

Related U.S. Application Data

(60) Provisional application No. 62/311,374, filed on Mar. 21, 2016.

(51) Int. Cl.
*A61H 31/00* (2006.01)
*A61H 31/02* (2006.01)
(Continued)

(52) U.S. Cl.
CPC ..... *A61H 31/02* (2013.01); *A61H 9/005* (2013.01); *A61H 23/0245* (2013.01);
(Continued)

(58) Field of Classification Search
CPC ..... A61H 31/02; A61H 2031/025
See application file for complete search history.

(56) References Cited

U.S. PATENT DOCUMENTS 2,065,982 A 12/1936 Nordin
2,079,952 A 5/1937 Sahlin
(Continued)

FOREIGN PATENT DOCUMENTS

FR 1051708 1/1954

*Primary Examiner* — LaToya M Louis
(74) *Attorney, Agent, or Firm* — Howson & Howson LLP

(57) ABSTRACT

An ambulatory respiratory assist device utilizes a cuirass worn on the chest and/or abdomen and supported by a hip belt so that it does not place a load on the patient's shoulders. The belt also supports a ventilator that includes a pump and its power supply, valving, controls and auxiliary equipment. The device is optionally integrated with auxiliary features such as chest wall vibration, which can be achieved by utilizing cuirass pressure modulation, with shoulder or upper arm supports for simulating the "tripod position", with positive pressure ventilation apparatus, or with patient monitoring. Shoulder or upper arm supports can extend directly from the belt to the shoulders or upper arms, utilized independently of the cuirass, and optionally integrated with one or more of the above-mentioned auxiliary features.

13 Claims, 8 Drawing Sheets

(51) Int. Cl.
*A61H 9/00* (2006.01)
*A61H 23/02* (2006.01)

(52) U.S. Cl.
CPC ..... *A61H 2201/0192* (2013.01); *A61H 2201/1207* (2013.01); *A61H 2201/165* (2013.01); *A61H 2201/1614* (2013.01); *A61H 2201/1619* (2013.01); *A61H 2201/1623* (2013.01); *A61H 2201/1628* (2013.01); *A61H 2201/5023* (2013.01); *A61H 2201/5071* (2013.01); *A61H 2205/084* (2013.01); *A61H 2230/405* (2013.01); *A61H 2230/425* (2013.01)

(56) References Cited

U.S. PATENT DOCUMENTS 2,287,939 A 6/1942 Kraft
2,309,361 A 1/1943 Terhaar
2,456,724 A 12/1948 Mullikin
2,466,108 A 4/1949 Huxley
2,480,980 A 9/1949 Terhaar
2,529,258 A 11/1950 Lobo
2,629,372 A 2/1953 Wallin
2,699,163 A * 1/1955 Engstrom ..... A61M 16/0057 601/44
2,759,474 A 8/1956 Kling
2,825,327 A 3/1958 Tunnicliffe
3,078,842 A 2/1963 Gray
3,368,550 A 2/1968 Glascock
3,961,626 A 6/1976 Houchen et al.
4,257,407 A 3/1981 Macchi
4,844,390 A 5/1989 Duke
4,881,527 A 11/1989 Lerman
4,945,899 A 8/1990 Sugiyama et al.
4,971,042 A 11/1990 Lerman
5,076,259 A 12/1991 Hayek
5,222,491 A 6/1993 Thomas
5,573,489 A 11/1996 Hayek
5,820,572 A 10/1998 Palmer
6,345,618 B1 2/2002 Hayek
6,488,641 B2 * 12/2002 Hansen ..... A61H 9/0078 137/565.16
6,910,479 B1 * 6/2005 Van Brunt ..... A61H 9/0078 128/200.24
8,202,237 B2 6/2012 Helgeson et al.
10,105,281 B1 10/2018 Costella
2002/0078958 A1 6/2002 Stenzler
2007/0276299 A1 11/2007 Jiang et al.
2008/0000477 A1 * 1/2008 Huster ..... A61B 5/01 128/204.23
2008/0167586 A1 * 7/2008 Baldauf ..... A61H 31/02 601/44
2009/0171256 A1 7/2009 Fiorina
2012/0174275 A1 7/2012 Carlson
2014/0113753 A1 * 4/2014 Craig ..... A63B 21/4007 473/450
2015/0045704 A1 2/2015 Lurie et al.
2016/0349738 A1 12/2016 Sisk
2017/0209334 A1 7/2017 Franoois et al.
2017/0304147 A1 * 10/2017 Glenn ..... A61M 16/10

* cited by examiner

AMBULATORY RESPIRATORY ASSIST DEVICE

CROSS-REFERENCE TO RELATED APPLICATION

This application claims the benefit of Provisional Application No. 62/311,374, filed on Mar. 21, 2016, and incorporates the entire disclosure thereof by reference.

FIELD OF THE INVENTION

The invention relates to medical devices, and particularly to devices for the treatment of dyspnea on exertion (DOE), as found in chronic obstructive pulmonary disease (COPD) and other respiratory disorders.

BACKGROUND OF THE INVENTION

COPD affects 15 million Americans. Of these, approximately twenty percent suffer from severe DOE that drastically limits their daily activities. COPD patients experience DOE for a variety of reasons. The central cause is their inability to breathe out quickly enough, as measured by a low FEV1 (Forced Expiratory Volume in 1 second). Upon the start of exertion, all individuals increase their respiratory rate and tidal volume, and thus their "minute ventilation," i.e., the volume of air breathed in one minute. But in COPD patients, their low FEV1 causes them to be unable to breathe out all the air from one breath before the next breath begins. This causes the lungs to inflate more and more with each breath, a phenomenon called "dynamic hyperinflation" (DH). DH has been shown to correlate better with DOE than any other variable. As DH increases, the patient's respiratory muscles have more work to do for each breath, causing the muscles to fatigue and create the sensation of DOE.

To combat DOE in COPD and other respiratory disorders, the most important goals are to help the patient breathe out faster in order to prevent DH, and to offload the work of the respiratory muscles. These goals have been addressed by an apparatus that will be referred to as a "cuirass/ventilator," a "cuirass/ventilator apparatus," or a "cuirass/ventilator combination," which is essentially a two-part apparatus composed of a cuirass and a ventilator.

A "cuirass" is a shell that fits over the anterior chest and/or the anterior abdomen, with a space between the chest/abdomen and the shell that can be alternately pressurized and evacuated by a ventilator, which includes a combination of a pump, a controller for controlling the operation of the pump from a power supply, and a user interface. As the patient inhales, the ventilator generates, between the cuirass and the patient's body, a subatmospheric pressure that lifts the chest and abdomen, drawing air into the lungs. As the patient exhales, the ventilator increases pressure in the cuirass, assisting the patient to breathe out. With the assistance of the cuirass/ventilator combination in the work of breathing, a patient no longer feels short of breath. U.S. Pat. No. 5,573,498, granted Nov. 12, 1996, and 6,345,618, granted Feb. 12, 2002, describe typical cuirass/ventilator combinations. These are smaller versions of the classic "iron lung" respiration apparatus used during the American polio epidemics, an early version of which is described in U.S. Pat. No. 1,834,580, granted Dec. 1, 1931.

Cuirass/ventilators have been in use since at least as early as the 1970s, but have been largely immobile. In a conventional cuirass/ventilator apparatus, the ventilator is a fixed unit, connected to the cuirass through a flexible hose. The cuirass of early cuirass/ventilator combinations was secured to the chest of the patient, who remained in a supine position. More recent cuirass designs allowed the patient to sit upright. However, because the ventilator is fixed, the patient's movement was limited by the length of the hose.

Although making such a device mobile so that the patient is able to utilize it while walking and carrying out other activities is desirable, heretofore no practical, comfortable, and aesthetically satisfactory, mobile cuirass ventilator has been introduced. Placing the ventilator component of the cuirass/ventilator combination on a cart or other rolling support is possible, but the combination is inconvenient for the patient, especially in that it makes it difficult for the patient to walk. An alternative, namely, carrying the ventilator component in a back-pack, is likewise unsatisfactory because the weight of the ventilator unit on the shoulders of a patient with severe COPD impairs the function of the accessory breathing muscles necessary for the COPD patient's breathing, i.e., the scalene muscles, pectorals, etc.

High frequency chest wall vibration (CWV) has been shown in clinical studies to relieve shortness of breath, and is believed to accomplish this by disrupting signals from the stretch receptors in the chest that are involved in creating the sensation of shortness of breath. Although the ability of CWV to relieve dyspnea was documented decades ago, it never successfully entered the clinical armamentarium. The reason CWV languished is that its effect on dyspnea is relatively small, and for that reason physicians were not enthusiastic about prescribing a CWV device, and patients were unwilling to undergo the inconvenience of wearing a device that only had a small benefit. A need exists for a way to enable and encourage patients to take advantage of the benefits chest wall vibration.

Positive pressure ventilators (PPVs) are commonly used to assist COPD patients in breathing. A PPV creates a positive pressure at the mouth, nose, and/or tracheostomy, pushing air into those orifices. However, a difficulty encountered in positive pressure ventilation is "increased airway impedance." A PPV usually exerts a positive pressure even during expiration, called PEEP (positive end-expiratory pressure), which is typically around 5 cm $H_2O$ relative to atmospheric. This positive pressure maintains open airways, but it increases the resistance against which the patient must exert effort in order to exhale. This increases the work of breathing for the patient.

Another problem associated with COPD is that shortness of breath results from fatigue in a patient's accessory breathing muscles. It has been observed that COPD patients breathe more comfortably when in a position known as the "tripod position." In the tripod position, the arms are supported on the knees or on some fixed object in front of the patient. It is for this reason that COPD patients often utilize front-wheel walkers, rollators, etc. However, the use of such aids is inconvenient, and there remains a need for a simple and easy way for a patient to achieve the effect of the tripod position while moving, without the use of an auxiliary device that the patient needs to grip and push.

SUMMARY OF THE INVENTION

A general object of this invention is to provide a practical cuirass/ventilator combination that is entirely carried on the patient s body, thereby allowing ambulation and engagement in normal daily activities. In other aspects of the invention, the cuirass/ventilator combination is integrated with other assistive mechanisms beyond mechanical ventilation, which need not provide full ventilation support, but can assist ventilation intermittently. Other aspects of the invention address one or more of the aforementioned problems relating to chest wall vibration and positive pressure ventilation.

In accordance with a first aspect of the invention, the ambulatory respiratory assist device comprises a cuirass, and an air pump, a portable power supply for operation of the pump, and a control comprising a sensor responsive to an effort by the patient to exhale, for causing the pump to deliver air to the cuirass to assist the patient in exhaling. The air pump, power supply and sensor together serve as a ventilator for the cuirass.

The cuirass preferably comprises a semi-rigid shell surrounded by a border shaped for engagement with the anterior chest and/or abdomen of the patient, i.e., an anterior portion of at least one of the chest and abdomen of the patient. The shell has a concave inner face shaped so that, when the border is in engagement with the patient's anterior chest and/or abdomen, an inflatable space is provided between the inner face of the shell and a portion of the patient's chest and/or abdomen within the border. Thus, a compressive force can be exerted against the patient's chest when the inflatable space is inflated with air, and a pulling force can be exerted on the patient's chest when air is evacuated from the inflatable space. Means are provided for maintaining the border of the cuirass in engagement with the aforementioned anterior portion of at least one of the chest and abdomen, and for supporting the weight of the cuirass when the patient is upright. The means for maintaining border-engagement and for supporting the weight of the cuirass includes a weight-supporting belt attached to the shell of the cuirass. The belt is adapted to be secured around a region of the patient's trunk which is at least in part between the pelvic girdle and the inferior border of the patient's sternum, and to support substantially the entire weight of the cuirass when the patient is upright.

The air pump is connected through the shell for inflation and evacuation of the inflatable space. The weight of the air pump and the portable power supply is also supported by the belt.

The means for maintaining the border of the cuirass in engagement with the patient's anterior chest and abdomen and for supporting the weight of the cuirass can include a second belt connected to the cuirass at two locations remote from the belt and adapted to extend around the patient's back from one of the two locations to the other.

Alternatively, the means for maintaining the border of the cuirass in engagement with the patient's anterior chest and abdomen and for supporting the weight of the cuirass can include a vest or other garment adapted to be worn by the patient. The cuirass can be permanently attached to the vest or other garment.

The sensor of the control can be not only responsive to an effort by the patient to exhale in order to cause the pump to deliver air to the cuirass, but also responsive to an effort by the patient to inhale for causing the pump to draw air from the inflatable space to assist the patient in inhaling.

The ambulatory respiratory assist device can also include shoulder or upper arm supports extending from, and connected to, portions of the cuirass shell remote from the belt and adapted to engage and support the patient's shoulders or upper arms, so that the patient's shoulders or upper arms are supported, through the shell, by the belt, thereby improving the mechanical advantage of the patient's accessory breathing muscles.

The ambulatory respiratory assist device can also include oscillating means for vibrating the patient's chest wall to aid in the relief of dyspnea. The vibration preferably takes place at a frequency of oscillation approximately equal to or exceeding 100 cycles per minute, and preferably in the range from approximately 100 to 200 cycles per minute.

Although chest wall vibration can be achieved by any of a variety of devices, such as piezoelectric vibrating bars or strips positioned between the ribs, preferably chest wall vibration is achieved by operating the pump in such a way as to superimpose an oscillation on the pressure exerted by the pump on the interior inflatable space.

The ambulatory respiratory assist device can also include a positive pressure ventilator, the weight of which is supported by the weight-supporting belt and means, preferably a nasal cannula adapted to be brought into sealing relationship with the patient's nostrils, connected though a flexible tube to the positive pressure ventilator, for delivering air from the positive pressure ventilator to the patient's trachea.

The ambulatory respiratory assist device can also be integrated with apparatus for monitoring one or more parameters such as the amount of time the ambulatory respiratory assist device is used by the patient and means for reporting the sensed parameter as an aid in the prediction of acute exacerbations.

An oxygen supply container can also be provided along with a nasal cannula connected to the oxygen supply container for delivering oxygen from the container to the patient for breathing. The weight of the oxygen supply container is supported by the weight-supporting belt.

Another aspect of the invention is the combination of the weight supporting belt with shoulder or upper arm supports connected to and extending from the belt either though a cuirass or directly. Thus, the ambulatory respiratory assist device can comprise a weight-supporting belt adapted to be secured around a region of a patient's trunk between the pelvic girdle and the inferior border of the patient's sternum, and a pair of supports connected to and extending from the belt. The supports have engaging portions adapted to engage the patient's axillae or upper arms, and thereby transmit the load of the patient's upper torso to the weight-supporting belt.

These shoulder or upper arm supports are preferably adjustable in length through a range, and capable of being locked at any selected length within that range.

These shoulder or upper arm supports can also be connected to the belt by hinges that allow rotation of the shoulder supports for anterior and posterior movement of their engaging portions.

The shoulder or upper arm supporting versions of the ambulatory respiratory assist device can be combined with oscillating means for vibrating the patient's chest, preferably at a frequency of oscillation approximately equal to or exceeding 100 cycles per minute.

The shoulder-supporting version of the ambulatory respiratory assist device can also be combined other auxiliary devices, including positive pressure breathing equipment or with an oxygen supply container supported by the weight-supporting belt and a nasal cannula connected to the oxygen supply container for delivering oxygen from the container to the patient for breathing.

The principal advantage of the cuirass/ventilator apparatus in accordance with the invention is that it aids the patient in breathing while allowing ambulation. Synergistic effects can be realized when the mobile cuirass/ventilator apparatus is integrated with auxiliary respiratory assisting features such as chest wall vibration, shoulder support, positive pressure ventilation, and patient monitoring equipment. Similar synergistic effects can be realized when the shoulder or upper arm-supporting feature is integrated with auxiliary respiratory assisting features such as chest wall vibration, positive pressure ventilation, and patient monitoring equipment, even without the mobile cuirass/ventilator apparatus.

DETAILED DESCRIPTION OF THE INVENTION

Figure 1:
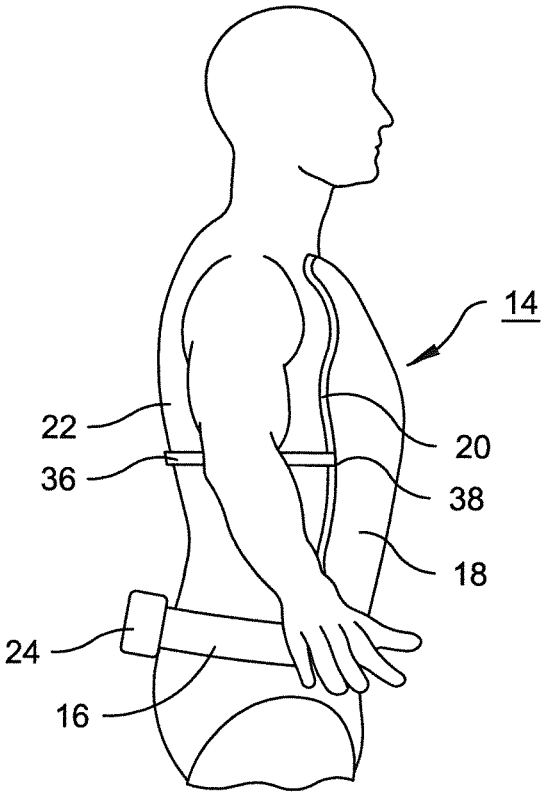
FIG. 1 is a schematic side elevational view of an individual wearing an ambulatory respiratory assist device in accordance with the invention.
Figure 2:
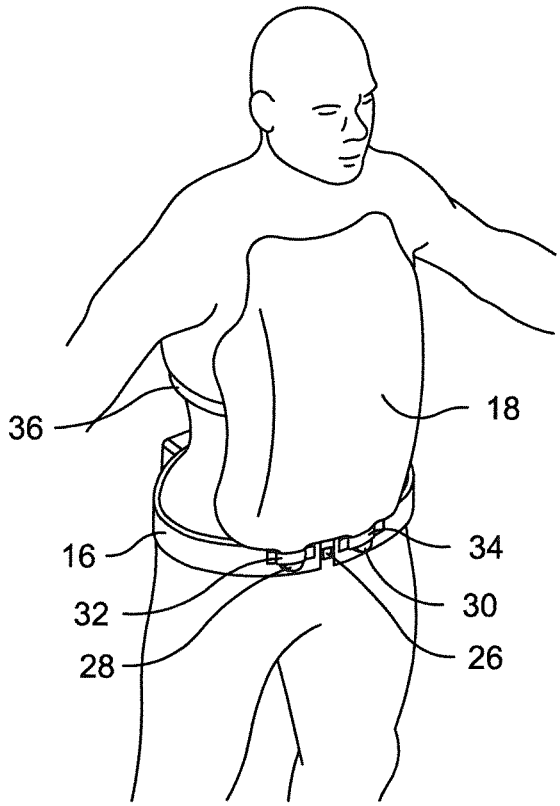
FIG. 2 is a schematic oblique perspective view of the individual and ambulatory respiratory assist device in FIG. 1.

As shown in FIGS. 1 and 2, a cuirass 14 is integrated with a belt 16. The cuirass 14 preferably comprises a semi-rigid shell 18, made from a synthetic resin such as a glycol modified polyethylene terephthalate (PETG). Such material possesses the appropriate flexibility and heat sensitivity that allow the cuirass shell to be made by vacuum forming. Other materials such as polycarbonate or acrylic resin can also be used for the cuirass shell.

The shell has a flexible, compressible border 20 for engagement either directly, or through an article of clothing with an individual's chest and abdomen. The border 20 forms a seal between the shell and the patient's chest, allowing the air pressure or vacuum in the cuirass to exert a force on the patient's chest. A sealing border can formed of any of various materials. For example, the border can be composed of a resilient, compressible, foam, as in U.S. Pat. No. 5,573,498. The foam can be, for example, an open-cell polyurethane foam, or any other suitable resilient, compressible foam capable of forming a suitable seal. Alternatively, the border can be composed of a resilient pleated seal as in U.S. Pat. No. 6,345,618. In still another version of the cuirass, an inflatable bag can be incorporated into the shell, and in that case, a special sealing border becomes unnecessary.

The belt 16 is configured to fit circumferentially around a region of the trunk of a patient 22, this region preferably being at least in part between the pelvic girdle and the inferior border of the patient's sternum. The belt is preferably a hip belt, i.e., a belt configured to fit around or slightly above the pelvic/sacral girdle and the gluteus maximi. However, it is possible to utilize a waist belt, i.e., one that fits above the iliac crest but below the inferior border of the sternum. When secured around a region that is at least in part between the pelvic girdle and the inferior border of the patient's sternum, the belt can provide support for the weight of the cuirass when the patient is upright. The belt also provides support for a portable ventilator unit 24, which may include a power supply in the form of an electric battery, and other equipment. The belt can also provide support for auxiliary equipment such as an oxygen tank. In addition, as described below, the belt may provide support for the patient's shoulders in order to aid the patient's accessory breathing muscles.

In the embodiment shown in FIGS. 1 and 2, the belt 16 is provided with a suitable buckle 26, which can be a conventional two part snap-fit buckle in which one of the two engageable parts is formed with a pair of resilient latches that can engage recesses in the other part and can be squeezed manually toward each other for release of the buckle. The cuirass is formed with a pair of downward protrusions 28 and 30, which are removably received in fabric loops 32 and 34 respectively. These fabric loops engage the lower part of the border of the cuirass shell 18 to support the weight of the shell.

One end of an additional belt 36 is secured to one side of the cuirass shell 18 at an intermediate location 38 between the upper and lower ends of the shell, extends around the patient's back, and is similarly secured to an opposite side of the shell. Belt 26 maintains the cuirass border in sealing engagement with the patient's chest and abdomen. The border can be maintained in sealing engagement with the patient's chest and abdomen in other ways, for example by being located inside an outer garment such as a shirt, jacket, vest, jumpsuit or the like, which can be custom-fitted in order to ensure proper engagement of the border of the cuirass with the patient's chest and abdomen. Custom fitting can be carried out by using measurements of the patient's body taken manually or by means of an imaging apparatus used in conjunction with a computer program that generates the appropriate dimensions for the custom-fitted garment. The belt can have a fixed diameter if custom-fitted. However, alternatively it can be made adjustable, by incorporating an adjustable strap, preferably on one or both sides of the belt.

Figure 3:
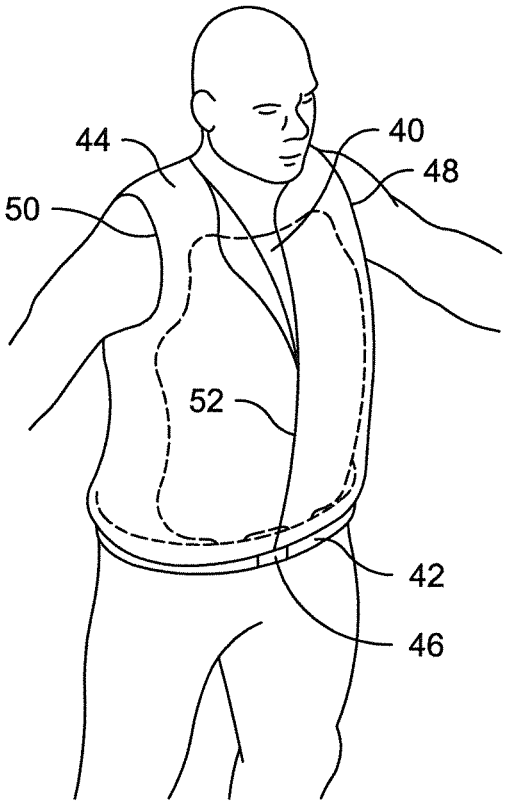
FIG. 3 is a front elevation showing an individual wearing a version of the ambulatory respiratory assist device in which the cuirass is integrated with a vest worn by the individual.

The cuirass can also be integrated with the garment, i.e., built into the garment so that the belt 26, or a similar temporary support to hold the cuirass in position, becomes unnecessary. In the example shown in FIG. 3, a cuirass 40 and its supporting belt 42 are permanently attached to a vest 44. The cuirass in this embodiment is attached to the inside of the portion of the vest covering the chest on the patient's left side, for example by sewing the vest to a flap (not shown) integrated with the cuirass. The downward protrusion corresponding to protrusion 30 in FIG. 2 remains in a supporting loop on the belt. The belt is secured to the vest on the patient's right side in such a way that the belt can be lowered to so that the cuirass-supporting loop on the patient's right side can be disengaged from the downward projection on the patient's right side. With the front of the vest opened and the belt 42 unbuckled by release of the buckle 46, the patient can put on the vest/cuirass/belt combination by sliding his left arm through the side opening 48 of the vest, positioning the cuirass against his chest, sliding his right arm through the opposite side opening 50, engaging the right side projection of the cuirass with the right side belt loop, and then buckling the belt and zipping the front opening of the vest closed along line 52. As in the embodiment in FIGS. 1 and 2, the belt can carry the ventilator including its power supply, and auxiliary equipment. The patient can put on and take off the integrated vest/belt/cuirass combination during normal daily activity, and has the option to wear the combination only when engaged in walking or other activity involving exertion.

Figure 4:
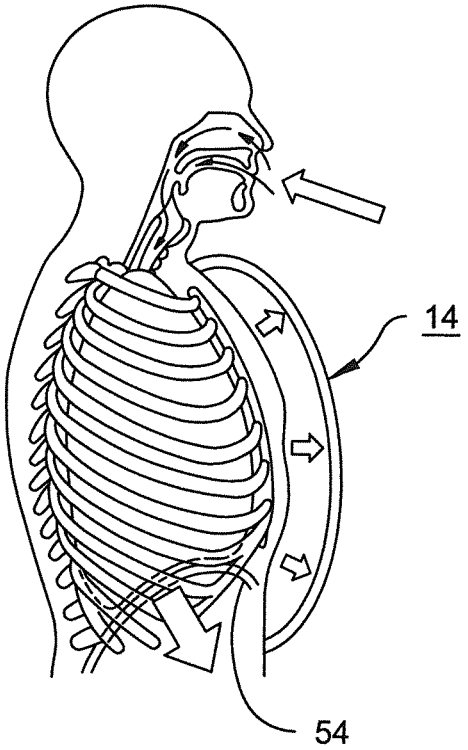
FIG. 4 is a schematic sectional view of a patient wearing a cuirass in accordance with the invention, showing the path of the inhaled air and the expansion of the chest and diaphragm upon inhalation.
Figure 5:
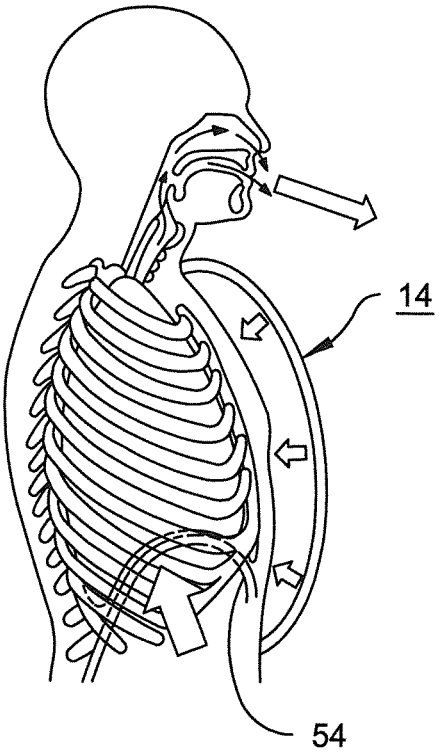
FIG. 5 is a schematic sectional view similar to FIG. 4, but, showing the contraction of the chest and diaphragm upon exhalation.

FIGS. 4 and 5 illustrate how the cuirass in the invention aids a patient in breathing. A patient utilizes both the diaphragm 54 and chest muscles in breathing. COPD patients have narrowed air tubes in their lungs which places an increased load on their respiratory muscles, causing those muscles to tire quickly during exertion. As the patient inhales, as shown in FIG. 4, the ventilator (not shown in FIGS. 4 and 5) senses the effort to inhale and draws air out of the cuirass shell lifting the chest. As the patient exhales as in FIG. 5, the ventilator senses the effort to exhale and pumps air into the cuirass, so that a compressive force is exerted on the chest. It is this compressive force that aids the patient in breathing out, and thereby prevents dynamic hyperinflation and the resultant muscle fatigue and dyspnea on exertion.

Figure 6:
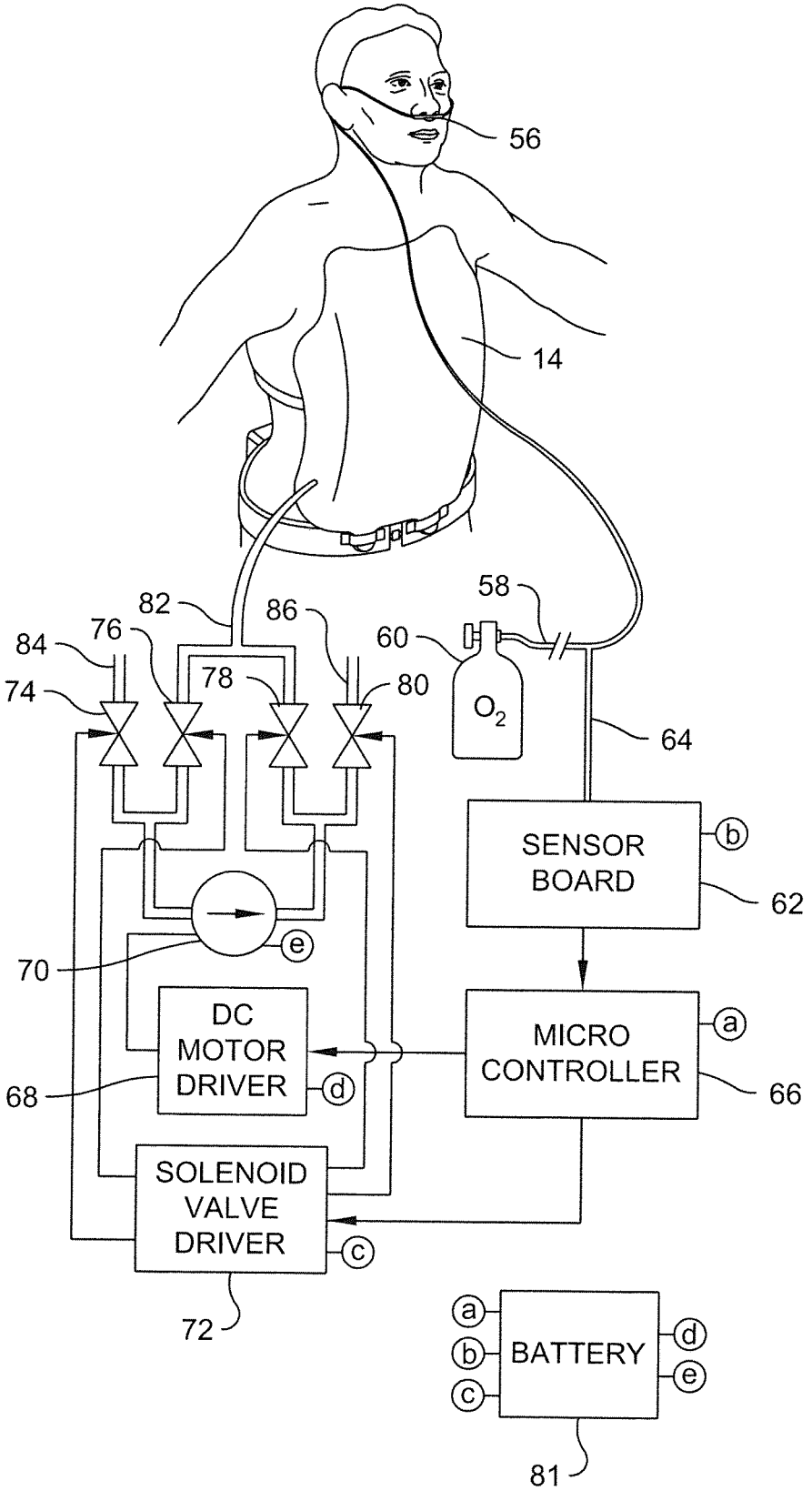
FIG. 6 is a schematic diagram illustrating details of the ventilator for delivering air to, and withdrawing air from, the cuirass of an ambulatory respiratory assist device in an embodiment in which the airflow is controlled by a patient's breathing as sensed through a nasal cannula.

In the embodiment of the invention shown in FIG. 6, a patient wearing the cuirass 14, is shown wearing a nasal cannula 56 connected through a tube 58 to an oxygen supply bottle 60, which can be worn on the cuirass-supporting belt. The ventilator includes a sensor board 62 connected to the oxygen tube 58 through a tube 64. The sensor board utilizes a flow sensor or pressure sensor to detect, and distinguish, the patient's efforts to inhale and exhale. In response to those efforts, the sensor signals a microcontroller 66, which operates a motor driver 68 to control the operation of an air pump 70, which is preferably a reciprocating piston pump having one or more check valves (not shown) at the inlet and outlet ports of its cylinder to establish one-way air flow in the direction indicated by the arrow on pump 70.

The microcontroller 66 also operates a solenoid valve driver 72, which controls the opening and closing of the valves in a set of four solenoid valves 74, 76, 78, and 80.

The sensor board, microcontroller, motor driver, pump and solenoid valve driver are powered from a power supply 81, preferably a battery of electrochemical cells, through connections indicated by letters a-e.

Solenoid valves 76 and 78 are connected respectively from the inlet and outlet ports of the pump 70 to a common flexible conduit 82 which leads to the interior space in the cuirass 14. Solenoid valves 74 and 80 are connected respectively from the inlet and outlet ports of the pump 70 to atmospheric intake and outlet ports 84 and 86.

In the operation of the ventilator, when the sensor board 62 detects inhalation, it causes the solenoid valve driver to close valves 74 and 78 and to open valves 76 and 80, thereby causing the pump 70 to draw a vacuum on interior of the cuirass through valve 76 and to exhaust the withdrawn air to the atmosphere through valve 80 and port 86. When the sensor board 62 detects exhalation, it causes the solenoid valve driver to close valves 76 and 80 and to open valves 74 and 78, thereby causing the pump 70 to draw air from the atmosphere through port 84 and valve 74 and to inflate the cuirass though valve 78 and conduit 82.

The microcontroller controls the timing of the valves to accommodate the patient's breathing pattern in order to avoid ventilator dyssynchrony, a problem common with ventilators and other respiratory assisting devices. The microcontroller can also control the motor driver in order to regulate the speed of operation of the pump and thereby regulate the pressures within the shell of the cuirass.

Figure 7:
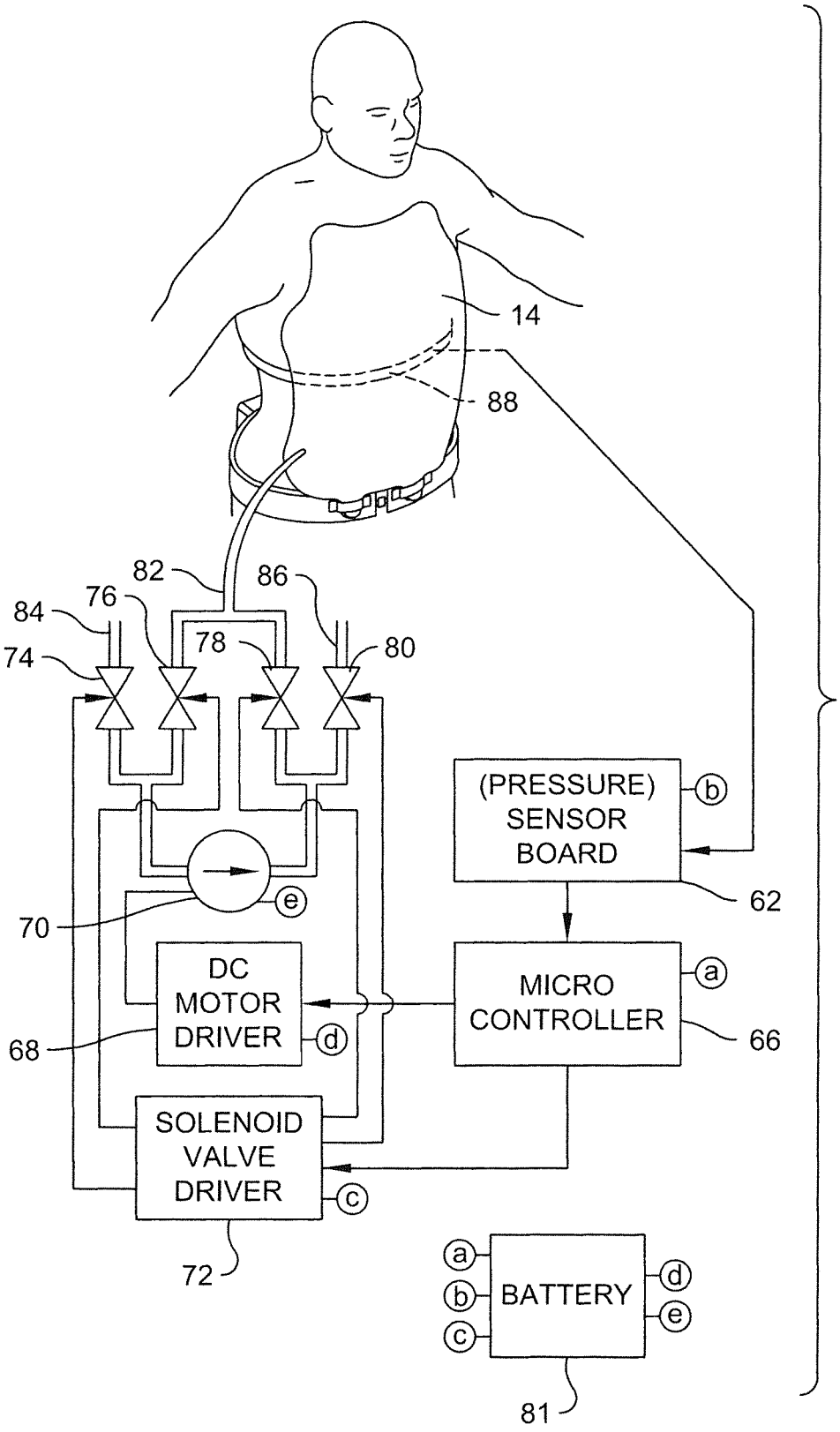
FIG. 7 is a schematic diagram illustrating details of the ventilator in an embodiment in which the airflow is controlled by a sensor in the form of a chest strap.

The ventilator system in FIG. 7 is similar to the ventilator system in FIG. 6 except that, instead of sensing pressure or air flow using a nasal cannula, the patient's breathing pattern is sensed by means of a chest strap 88, which can be in the form of a strain sensor, or can include one or more sensor elements such as a plethysmography band or a chest impedance sensor. The nasal cannula sensing system of FIG. 6 and the chest strap sensing system of FIG. 7 can be combined.

The ventilator can also be controlled by a sensor (not shown) responsive to pressure in the cuirass shell, or by various combinations of two or more sensors including a nasal cannula sensor, a chest strap sensor, and a cuirass pressure sensor.

The cuirass/ventilator apparatus can also be utilized concurrently with a positive pressure ventilator (PPV). A PPV creates a positive pressure at the patient's mouth, nose, and/or trachoestomy, pushing air into those orifices. The combination of the cuirass/ventilator apparatus with the positive pressure ventilator is synergistic in that it can prevent dynamic airway collapse (DAC), which can be caused not only by increased expiratory effort by the patient but also by the cuirass-ventilator. In DAC, external pressure on the small airways causes those airways to collapse. Further increase in intrathoracic pressure cannot increase air flow rate because of "choke points" in small airways. By combining PPV with cuirass ventilation-based compression of the thorax, the airways are stented open by the PPV and therefore not collapsed by the pressure exerted on the thorax by the cuirass/ventilator. Therefore, air can flow more rapidly out of the patient's airways than in the case of a cuirass/ventilator apparatus used by itself.

Figure 8:
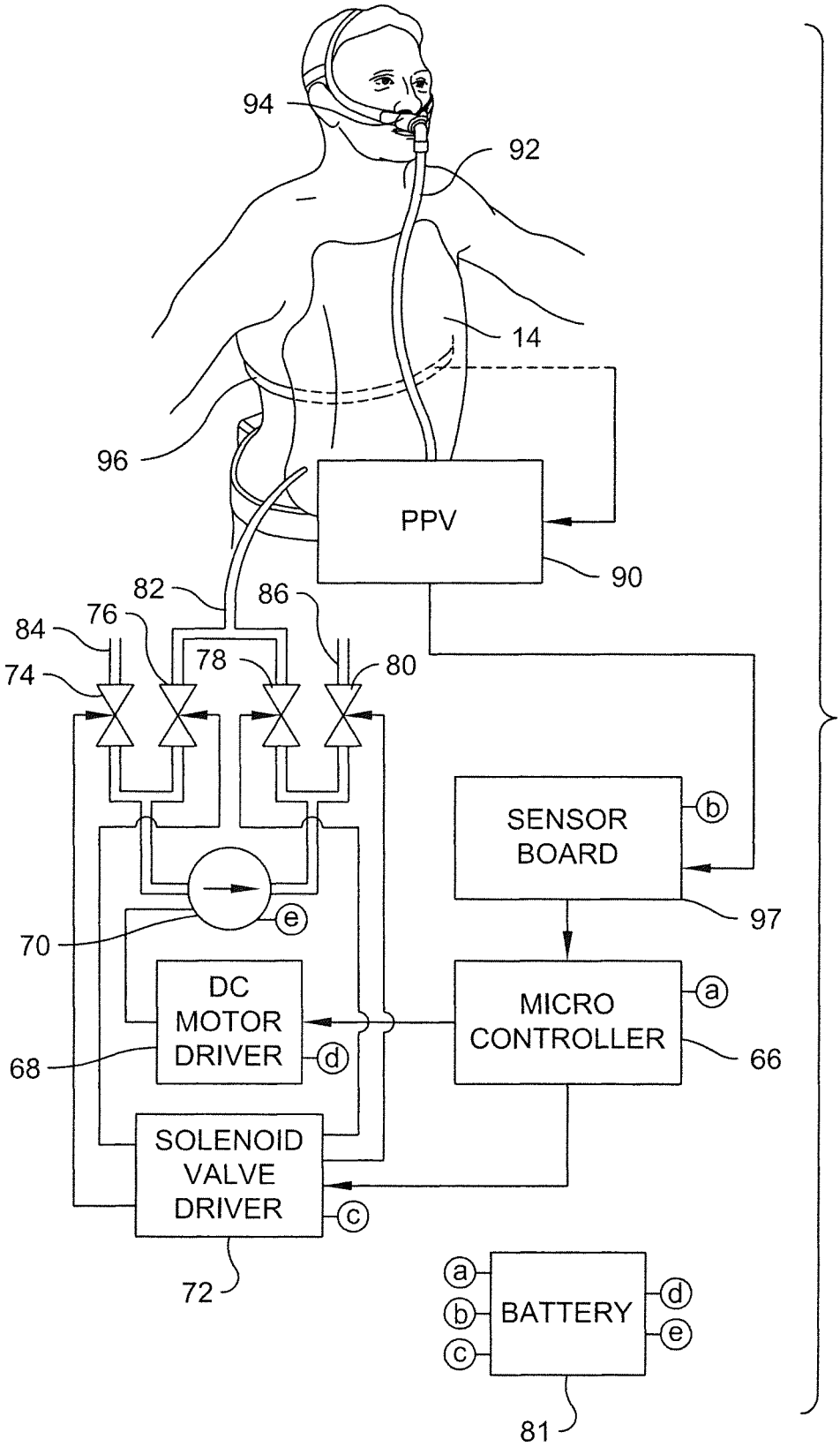
FIG. 8 is a schematic diagram illustrating details of the ventilator in an embodiment in which the airflow is controlled by a sensor in the form of a chest strap as in FIG. 7 and in which the ventilator for delivering air to, and withdrawing air from, the cuirass is used in conjunction with a positive pressure ventilation apparatus.

In the embodiment illustrated in FIG. 8, a cuirass/ventilator apparatus corresponding to the apparatus shown in FIG. 7 is combined with a positive pressure ventilator (PPV) 90. The positive pressure ventilator aids the patient delivers air through a flexible tube 92 to a "pillow" type nasal cannula 94, a cannula configured to establish a sealing relationship between the tube 92 and the patient's nostrils during inhalation. A mask can be used as an alternative to the pillow cannula.

The positive pressure ventilator 90 in this embodiment is responsive to signals pressure sensor board is responsive to signals from a chest strap sensor 96, similar to the chest strap sensor 88 in FIG. 7, and the sensor board 97, through which the ventilator of the cuirass/ventilator apparatus is controlled is responsive to signals from the positive pressure ventilator. As in the embodiments illustrated in FIGS. 7 and 8, the ventilator of the cuirass/ventilator apparatus of FIG. 9 can be controlled by signals from other sensors or from combinations of sensors The PPV can have a variety of different pressure vs. time functions, such as CPAP (continuous positive pressure ventilation) or BiPAP (alternating between higher and lower pressure levels), or more complex functions of pressure vs. time. The cuirass-ventilator combination and the PPV can be synchronized, with time delays in some cases, and share sensor information with each other. A variety of interfaces between the PPV and patient can be used. These interfaces include, but are not limited to: a nasal cannula (which can be generic or custom-fit, or concealed with eyeglasses for aesthetics), the nasal pillow cannula, a high-flow nasal cannula, a full or partial face mask, and tracheostomy variants. In the case of a tracheostomy, a very small tracheostomy can be utilized, since, in the case of a combination of the cuirass/ventilator apparatus and PPV, the cuirass/ventilator combination does not need to provide full ventilatory support, and is assisted by, and provides assistance to, the positive pressure ventilator.

As mentioned above, it has been observed that COPD patients breathe more comfortably when in a position known as the "tripod position." In the tripod position, the arms are supported on the knees or on some fixed object in front of the patient. It is for this reason that COPD patients often utilize front-wheel walkers, rollators, etc.

The cuirass-ventilator apparatus of the invention can be adapted to achieve an effect similar to that of the "tripod position," by including elements that support the shoulders and chest from the belt surrounding the region of the patient's trunk between the pelvic girdle and the inferior border of the sternum.

Figure 9:
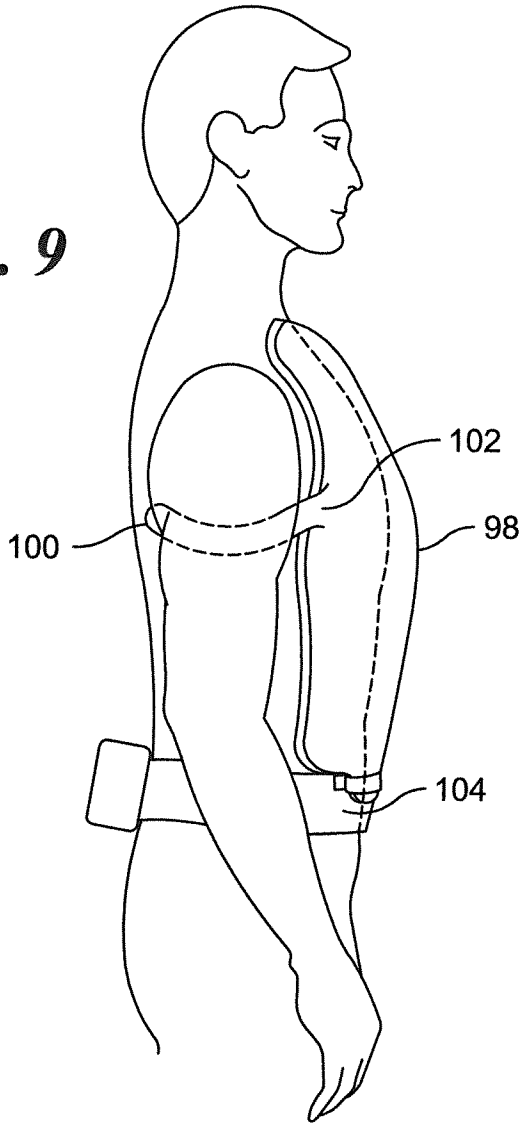
FIG. 9 is a schematic side elevational view of an individual wearing an ambulatory respiratory assist device in accordance with the invention, in which the cuirass is equipped with shoulder supports for improving the mechanical advantage of accessory breathing muscles.

In an embodiment shown in FIG. 9, the cuirass 98 of a cuirass-ventilator apparatus is provided with underarm engaging elements, similar in shape to the underarm engaging parts of a crutch, that engage and support the axillae of the patient. One such engaging element 100 is fixed to and extends from the cuirass at a location 102 adjacent the border of the cuirass on the patient's right side and remote from the belt. A similar engaging element (not shown) is provided on the opposite border of the cuirass. The positions of the engaging elements on the cuirass can be determined in the process of designing the cuirass to fit a particular patient.

The load imposed by the patient's shoulders on these two shoulder supports is transmitted through the cuirass to the cuirass supporting belt 104. Thus, in this embodiment, the cuirass serves two purposes: its inflation and deflation by the ventilator aids in respiration by alternately lifting and compressing chest, and its shell provides a simple mounting for the shoulder supports, which also aid respiration, complementing the effect of inflation and deflation of the cuirass by relieving the auxiliary breathing muscles.

Figure 10:
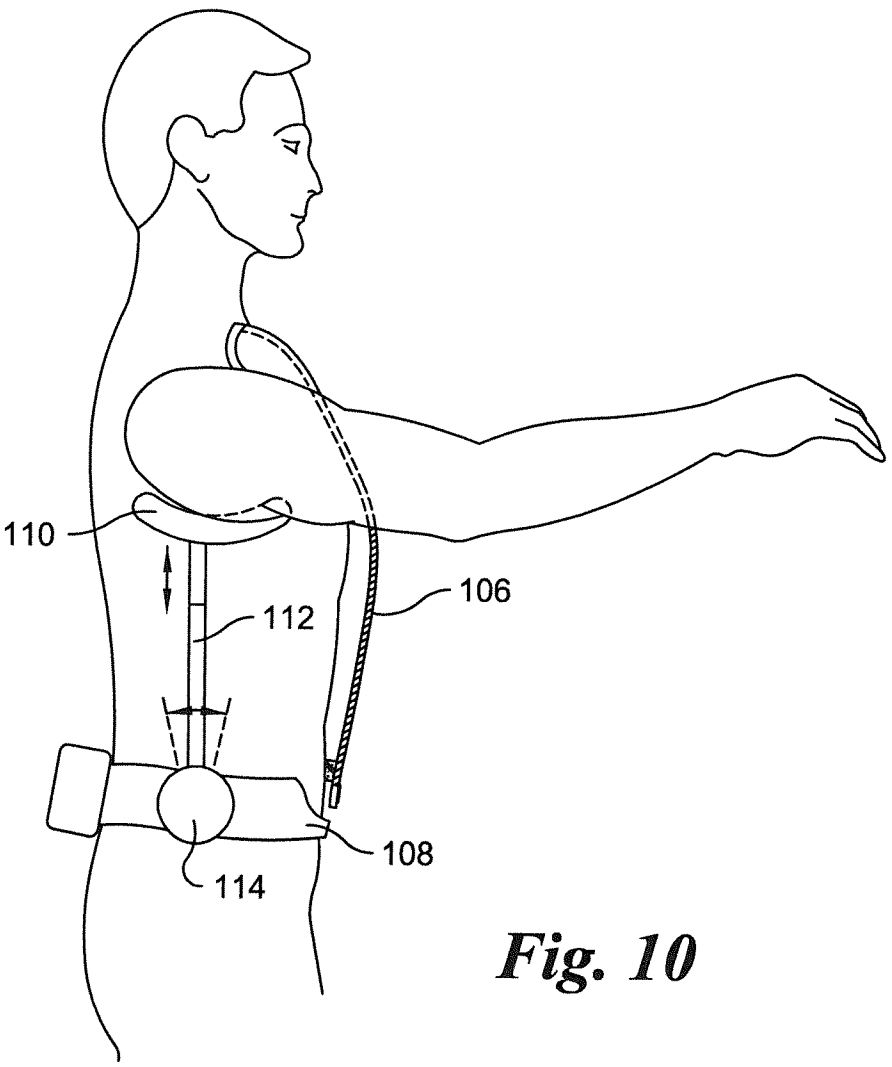
FIG. 10 is a schematic side elevational view of an individual wearing an ambulatory respiratory assist device in accordance with the invention, in which shoulder supports are connected directly to a belt worn by the patient.

In an alternative embodiment depicted in FIG. 10, the shoulder engaging elements are independent of the cuirass and can be utilized either with or without the cuirass/ventilator combination. The cuirass 106 is supported by the belt 108. A shoulder engaging portion 110 is shown in engagement with the axilla on the patient's right side, and connected to the belt 108 through a strut 112. The strut is adjustable in length, and capable of being locked at any length within its range of adjustment. The strut is connected to the belt by a hinge 114. A similar structure (not shown) is provided on the patient's left side. The adjustability of the lengths of the struts allows the shoulder supports to be fitted to the patient, and the hinges allow rotation of the shoulder supports for anterior and posterior movement of the shoulder engaging portions, allowing the patient additional freedom of movement. The belt and shoulder support can be utilized with or without the cuirass/ventilator.

In another embodiment, the cuirass-ventilator apparatus or a device designed to support a patient's shoulders from the hips, is combined with an apparatus that effects chest wall vibration. Chest wall vibration has been shown to decrease dyspnea on exertion (DOE). The vibration is believed to confuse the sensors in the chest wall, lungs, and diaphragm that detect stretch and create the sensation of shortness of breath. The cuirass, which is already on the chest, can serve as a platform for chest wall vibration.

The effect of chest wall vibration (CWV) on dyspnea is relatively small, and consequently, it has not come into widespread use. Because of the relatively small effect of chest wall vibration, physicians have not enthusiastically prescribed CWV devices. Moreover, patients have been unwilling to undergo the inconvenience of wearing a device that only had a small benefit. However, when incorporated into a cuirass/ventilator combination, or into an apparatus that aids in breathing while providing for patient mobility by supporting the patient's shoulders or upper arms from the hips, a chest wall vibration apparatus can provide additional benefits that are desirable both to the physician and to the patient.

Chest wall vibration can be achieved in any of various ways, such as by the use of piezoelectric vibrating strips or bars fitted between the patient's ribs. However, in the case of the cuirass/ventilator apparatus described above, the vibration can be effected by superimposing on the pressure variation cycle at the breathing rate in the cuirass, typically an inhalation/exhalation cycle at a rate in range from approximately 6 to 60 cycles per minute, a higher frequency pressure oscillation preferably at a frequency of at least approximately 100 cycles per minute, and preferably in the range from approximately 100 to 200 cycles per minute. The superimposed pressure oscillation can be achieved by utilizing a piston pump and solenoid valves as in the embodiments in FIGS. 6, 7 and 8, and operating the piston pump at the superimposed frequency while controlling the solenoid valves so that they open and close at a rate corresponding to the patient's the breathing rate.

Figure 11:
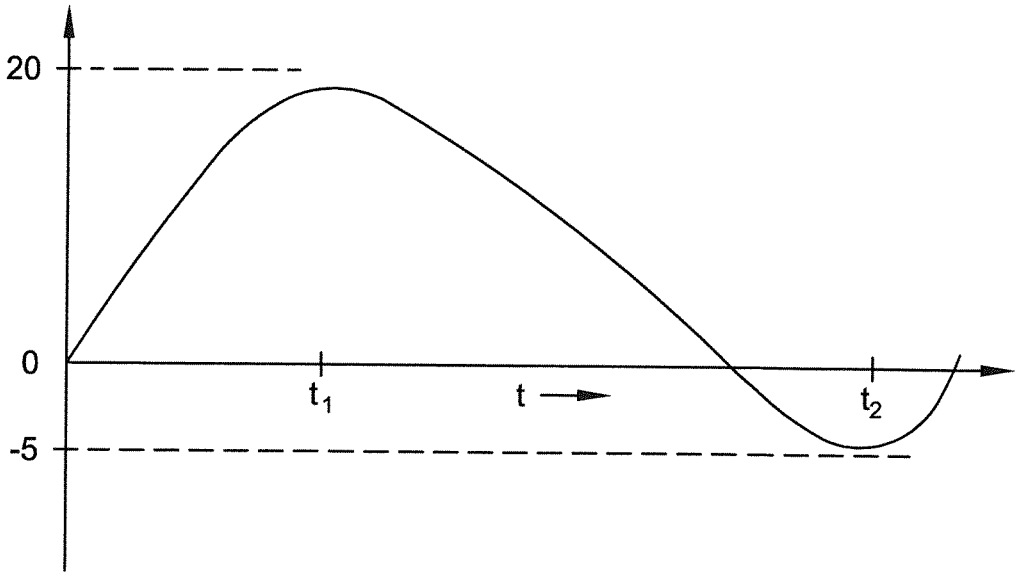
FIG. 11 is a graph illustrating a typical variation of pressure in the cuirass of the invention over a breathing cycle.

As shown in FIG. 11, in order to aid the patient in the work of breathing, the air pressure in the cuirass varies over a breathing cycle from atmospheric pressure (indicated by the solid horizontal base line, from a high, typically around +20 cm $H_2O$ relative to atmospheric, to a low, typically around −5 cm $H_2O$ relative to atmospheric. During expiration, air is introduced into the cuirass, causing the pressure in the cuirass to rise to the maximum level. The solenoid valves are then switched at time $t_1$, causing the pump to withdraw air from the cuirass until the internal pressure reaches the minimum value. The solenoid valves are switched again at time $t_2$ to cause the pump to reinflate the cuirass. Expiration by the patient begins approximately at time $t_1$, and inspiration begins approximately at time $t_2$. The timing of the inflation/deflation cycle is controlled by the microcontrollers in response to the patient sensors in the ventilators shown in FIGS. 6, 7 and 8.

Figure 12:
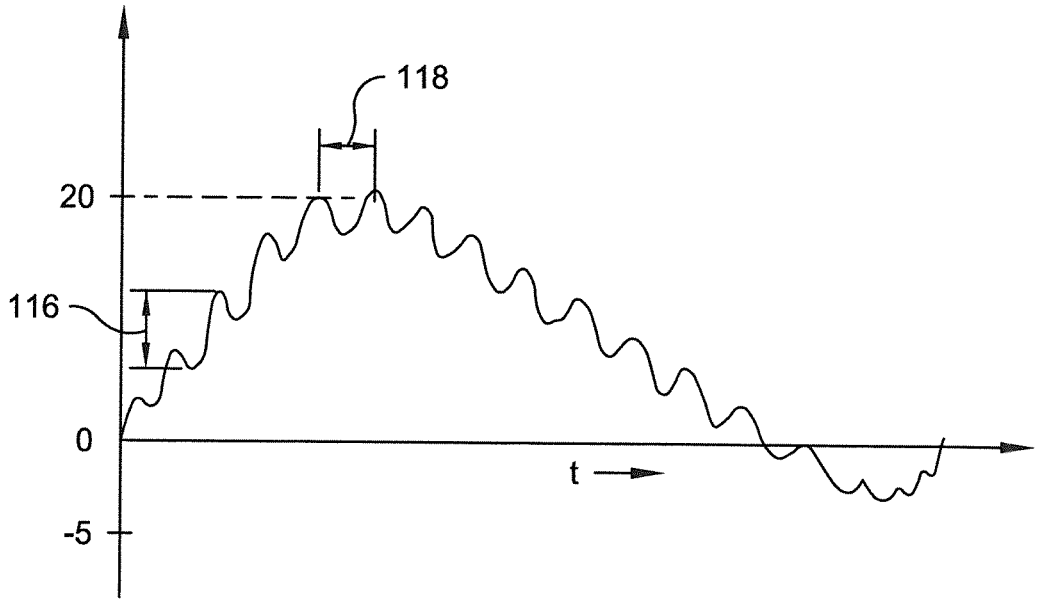
FIG. 12 is a graph illustrating a typical variation of pressure in the cuirass of the invention over a breathing cycle in an embodiment in which a repeating pressure variation at a rate higher than patient's the breathing frequency is superimposed on the pressure within the cuirass in order to effect chest wall vibration.

When chest wall vibration is achieved by varying the air pressure in the cuirass, a typical pressure variation over the breathing cycle is as shown in FIG. 12. The operation of the piston pump superimposes a high frequency, low-amplitude pressure variation on the high amplitude pressure variation corresponding to the low-frequency breathing cycle. The peak-to peak amplitude of the superimposed high frequency oscillations is indicated at 116 and the period, of these oscillations is indicated at 118. The frequency of these superimposed oscillations is desirably at least approximately 100 cycles per minute, and preferably in the range from approximately 100 cycles per minute to approximately 200 cycles per minute. The amplitude 116 of the superimposed pressure variations can be controlled by utilizing a variable displacement pump as the pump 70 in FIGS. 6-8, and the period 118 of the oscillations can be controlled by controlling the speed of operation of the pump motor. Both variables can be controlled by microcontroller 66.

The magnitude of the superimposed pressure variations can also be controlled by the use of a pressure accumulator, and, when chest wall vibration is not desired, the accumulator can be utilized to eliminate the pressure variations substantially completely, in order to achieve a pressure variation cycle similar to that depicted in FIG. 11.

The ambulatory respiratory assist device can also include a sensor for monitoring at least one parameter of a set of parameters consisting of the amount of time the ambulatory respiratory assist device is worn by the patient, the amount of time the ambulatory respiratory assist device is used by the patient, the distance traveled by the patient in a predetermined interval, the patient's heart rate, the patient's pulse oximetry, and automated chest auscultation data of the chest. In this case, means are provided for reporting the sensed parameter either to the patient, or to another individual, e.g., a family member or the patient's physician. Reports of sensed variables can be used to aid in the prediction of acute exacerbations. For example if the patient's activity, such as the amount of walking, decreases for a few days in a row, this may predict an acute exacerbation, and the care providers and patients can be alerted via text message, telephone, or by other suitable means.

The cuirass-ventilator apparatus of the invention can also be utilized with chest wall strapping (CWS), i.e., the placement of constrictive bands around the chest to decrease chest wall and/or chest compliance. CWS has been shown to improve DOE in COPD patients. The chest wall strapping can be independent of the cuirass, or can utilize straps that secure the cuirass to the patient's chest. In the latter case, tension around the chest is increased by increasing the pressure between the cuirass shell and the patient's body.

What is claimed is:

1. An ambulatory respiratory assist device comprising:

a cuirass comprising a shell surrounded by a border shaped so that the entirety of said border is engageable with an anterior portion of at least one of a chest and an abdomen of a patient, said border having opposite, upwardly extending, side portions, said shell having a concave inner face shaped so that, when said border is in engagement with said anterior portion, an inflatable space is provided between said inner face of the shell and Said anterior portion within said border, whereby a compressive force can be exerted against said anterior portion when said space is inflated with air, and a pulling force can be exerted on the said anterior portion when air is evacuated from said space;

means for maintaining said border of the cuirass in engagement with the said anterior portion and for supporting the weight of said cuirass when the patient is upright, said means including a weight-supporting belt attached to said shell, at least part of said weight-supporting belt being adapted to be secured around a region of the patient's trunk, said region being between the pelvic girdle and the inferior border of the patient's sternum, and to support substantially the entire weight of the cuirass when the patient is upright, said weight-supporting belt is secured around said region of the patient's trunk, and said border of the cuirass is in engagement with said anterior portion of at least one of the chest and abdomen of said patient;

a pair of rigid underarm supporting elements integrated with the shell, each underarm-supporting element extending radially outward from one of the upwardly extending side portions of said border of said shell at a location such that it engages and supports an axilla of the patient when said border of the shell is in engagement with said anterior portion of at least one of the chest and abdomen of said patient, the underarm-supporting elements being sized and configured to provide sufficient underarm support to relieve auxiliary breathing muscles of the patient;

an air pump connected through said shell for inflation of said inflatable space; and control means, comprising a sensor responsive to an effort by the patient to exhale, for causing said pump to deliver air to said inflatable space to assist the patient in exhaling;

wherein said shell has sufficient rigidity to transmit the load of the upper torso of said patient to said region of the patient's trunk through said weight-supporting belt.

2. The ambulatory respiratory assist device according to claim 1, wherein said means for maintaining said border of the cuirass in engagement with said anterior portion and for supporting the weight of said cuirass includes a second belt connected to said cuirass at two locations remote from said weight supporting belt and adapted to extend around the patient's back from one of said locations to the other.

3. The ambulatory respiratory assist device according to claim 1, wherein said means for maintaining said border of the cuirass in engagement with said anterior portion and for supporting the weight of said cuirass includes a garment adapted to be worn by the patient, said cuirass being permanently attached to said garment.

4. The ambulatory respiratory assist device according to claim 1, wherein said means for maintaining said border of the cuirass in engagement with said anterior portion and for supporting the weight of said cuirass includes a vest adapted to be worn by the patient, said cuirass being permanently attached to said vest.

5. The ambulatory respiratory assist device according to claim 1, wherein said sensor of the control means is also responsive to an effort by the patient to inhale, and said control means is also for causing said pump to draw air from said inflatable space to assist the patient in inhaling.

6. The ambulatory respiratory assist device according to claim 1, including oscillating means for vibrating the patient's chest at a frequency of oscillation approximately equal to or exceeding 100 cycles per minute.

7. The ambulatory respiratory assist device according to claim 1, including oscillating means for vibrating the patient's chest at a frequency of oscillation in the range from approximately 100 to 200 cycles per minute.

8. The ambulatory respiratory assist device according to claim 1, wherein said pump includes means for superimposing an oscillation on the pressure exerted by said pump on the interior of said inflatable space, said oscillation being at a frequency approximately equal to or exceeding 100 cycles per minute.

9. The ambulatory respiratory assist device according to claim 1, wherein said pump includes means for superimposing an oscillation on the pressure exerted by said pump on the interior of said inflatable space, said oscillation being at a frequency in the range from approximately 100 to 200 cycles per minute.

10. The ambulatory respiratory assist device according to claim 1, including a positive pressure ventilator the weight of which is supported by said weight-supporting belt and means, connected though a flexible tube to said positive pressure ventilator, for delivering air from said positive pressure ventilator to the patient's trachea.

11. The ambulatory respiratory assist device according to claim 1, including a positive pressure ventilator the weight of which is supported by said weight-supporting belt and a nasal cannula adapted to be brought into sealing relationship with the patient's nostrils and connected though a flexible tube to said positive pressure ventilator, for delivering air from said positive pressure ventilator to the patient's trachea through the nostrils.

12. The ambulatory respiratory assist device according to claim 1, including a nasal cannula and a sensor for monitoring at least one parameter of a set of parameters consisting of the amount of time the ambulatory respiratory assist device is worn by the patient, the amount of time the ambulatory respiratory assist device is used by the patient, the distance traveled by the patient in a predetermined interval; the patient's heart rate, the patient's pulse oximetry, and automated chest auscultation data of the chest, and means for reporting the sensed parameter.

13. The ambulatory respiratory assist device according to claim 1, including an oxygen supply container supported by said weight-supporting belt and a nasal cannula connected to said oxygen supply container for delivering oxygen from said container to the patient for breathing.

* * * * *